US009096336B2

(12) United States Patent
Maas et al.

(10) Patent No.: US 9,096,336 B2
(45) Date of Patent: Aug. 4, 2015

(54) DEVICE AND METHOD FOR PACKAGING BULK MATERIAL

(75) Inventors: Franciscus Arnoldina Gerardus Jozef Maas, Eersel (NL); Godefridus Hendrikus Theodorus Franciscus Hendrikx, Hooge Mierde (NL)

(73) Assignee: Premier Tech Chronos B. V., Eersel (NL)

( * ) Notice: Subject to any disclaimer, the term of this patent is extended or adjusted under 35 U.S.C. 154(b) by 600 days.

(21) Appl. No.: 13/388,084

(22) PCT Filed: Jul. 26, 2010 (Under 37 CFR 1.47)

(86) PCT No.: PCT/NL2010/050483

§ 371 (c)(1), (2), (4) Date: Jun. 12, 2012

(87) PCT Pub. No.: WO2011/014067

PCT Pub. Date: Feb. 3, 2011

(65) Prior Publication Data

US 2012/0298253 A1 Nov. 29, 2012

(30) Foreign Application Priority Data

Jul. 31, 2009 (NL) ..... 2003319

(51) Int. Cl.

| | |
|---|---|
| ***B65B 1/12*** | (2006.01) |
| ***B65B 31/04*** | (2006.01) |
| ***B65B 1/26*** | (2006.01) |
| ***B65B 39/12*** | (2006.01) |

(52) U.S. Cl.

CPC ..... *B65B 31/044* (2013.01); *B65B 1/12* (2013.01); *B65B 1/26* (2013.01); *B65B 31/041* (2013.01); *B65B 39/12* (2013.01)

(58) Field of Classification Search

CPC ..... B65B 1/12; B65B 1/26; B65B 31/041; B65B 31/044

USPC ..... 141/5, 7, 63–64; 222/410–413

See application file for complete search history.

(56) References Cited

U.S. PATENT DOCUMENTS

| | | | | |
|---|---|---|---|---|
| 3,039,882 | A | 6/1962 | Clinton et al. | |
| 3,708,952 | A | 1/1973 | Schulze et al. | |
| 4,054,161 | A * | 10/1977 | Alack | 141/12 |
| 4,077,541 | A * | 3/1978 | Murray | 222/1 |
| 4,895,274 | A * | 1/1990 | Morimoto et al. | 222/63 |
| 6,021,821 | A * | 2/2000 | Wegman | 141/93 |
| 6,024,141 | A * | 2/2000 | Wegman | 141/59 |

(Continued)

FOREIGN PATENT DOCUMENTS

| | | |
|---|---|---|
| DE | 2363405 A1 | 7/1975 |
| EP | 0184166 A1 | 6/1986 |
| FR | 2041901 | 2/1971 |

(Continued)

*Primary Examiner* — Nicolas A Arnett

(74) *Attorney, Agent, or Firm* — The Webb Law Firm

(57) ABSTRACT

A device for packaging bulk material such as milk powder is disclosed. The device includes a dispensing unit for dispensing the bulk material into a package, an apparatus for supplying the bulk material to the dispensing unit and an apparatus for emitting a gas, such as CO2 or a gas mixture of nitrogen and CO2, during the packaging. The device is further provided with an apparatus for emitting a gas for driving oxygen out of the package before dispensing of the bulk material. A method for packaging a bulk material is also disclosed.

12 Claims, 3 Drawing Sheets

(56) References Cited

U.S. PATENT DOCUMENTS

| | | | | |
|---|---|---|---|---|
| 7,836,922 | B2 * | 11/2010 | Poole et al. | 141/72 |
| 8,201,591 | B2 * | 6/2012 | Monti | 141/81 |
| 8,544,507 | B2 * | 10/2013 | Matsumoto et al. | 141/12 |
| 2008/0236701 | A1 * | 10/2008 | Monti | 141/5 |

FOREIGN PATENT DOCUMENTS

| | | |
|---|---|---|
| GB | 1427130 | 3/1976 |

* cited by examiner

DEVICE AND METHOD FOR PACKAGING BULK MATERIAL

BACKGROUND OF THE INVENTION

1. Field of the Invention

The present invention relates to a device for packaging bulk material. The invention relates particularly to the packaging of possibly perishable bulk material, for instance food products such as milk powder.

2. Description of Related Art

In the packaging of such products for the purpose of wholesale or further processing relatively large packages are filled with the products, which are here often in powder form. It is desirable here for many reasons that the packages remain free of oxygen. Not only can the products perish due to enclosed oxygen, the oxygen can also cause clumps to form in the products or cause the thus filled packages to become large in volume and unstable during the stacking thereof because of the enclosed oxygen.

For this purpose it is known to add gas, such as $CO_2$ or a gas mixture of nitrogen and $CO_2$, to the bulk material during the transfer of the bulk material for the purpose of preparation or packaging. This usually takes place before or during a transfer, when the gas is transferred via a hopper or other through-feed means from a first holder, such as a container, to a second holder. The bulk material is then transferred to a package at a later stage, wherein oxygen can once again get into the product. Although attempts are therefore often made to drive this undesired oxygen out of the package by compressing, pressing or blowing in gas, experience has shown that the oxygen is in this way not driven out of the package to sufficient extent. It is therefore an object of the present invention to arrive at an improved method for low-oxygen or oxygen-free packaging of bulk materials, or to provide a usable alternative.

SUMMARY OF THE INVENTION

The invention proposes for this purpose a device for packaging bulk material, comprising a dispensing unit for dispensing the bulk material into a package, means for supplying the bulk material to the dispensing unit and means for emitting a gas during the packaging.

Adding the gas during the packaging ensures that the bulk material is completely oxygen-free at the moment of packaging. A lower-oxygen end result is hereby achieved relative to the prior art, in which the bulk material is made oxygen-free before packaging but may come into contact with oxygen again during the transport to the device for packaging and during the packaging. It has been found in practice that an oxygen percentage of 1% in a package is achievable. A second advantage is that the quantity of gas required for filling a package with a determined quantity of bulk material is considerably lower since in the prior art devices the gas can be displaced by oxygen. Gas being driven into the bulk material before the bulk material is dispensed is otherwise not per se precluded here, but for efficiency reasons it is recommended that this not be done at a location such that the bulk material comes into contact with oxygen again before being packaged.

The introduction of the gas into the bulk material, whether this takes place during the packaging or beforehand, preferably takes place according to the present invention particularly counter to the flow of the bulk material. A particularly high degree of mixing of the gas and the bulk material is hereby achieved. This effect can be still further enhanced by admixing the gas at a location of the device where the bulk material is displaced with at least a directional component in the direction of the force of gravity, since the gas has a natural tendency to move in opposite direction to the force of gravity.

In an advantageous embodiment the device is further provided with means for emitting a gas for driving oxygen out of the package before dispensing of the bulk material. This ensures that the package is oxygen-free or at least low-oxygen prior to and during the dispensing so that oxygen already present in the package cannot have an adverse effect on the product.

The dispensing unit can for instance comprise a diffuser, wherein the means for emitting a gas are adapted to emit the gas to a surface of the diffuser. Such diffusers are based on the principle that the bulk material is placed on a moving (translating or rotating) surface, for instance by being poured thereon, and is dispersed by the movement of the diffuser. This also prevents clump-formation in the bulk material because parts of the product are broken apart the moment they come into contact with the diffuser. This latter can be provided for this purpose with a relief which further enhances spreading and breaking up of the bulk material. Now emitting the gas just on the surface of the diffuser, i.e. the location where the bulk material is most finely distributed, achieves that the gas can permeate in optimal manner between the parts of the bulk material and the package comprises substantially only bulk material and gas.

In a preferred embodiment the diffuser has a cone shape, wherein the means for emitting the gas comprise openings on the envelope of the cone. A cone shape has the advantage that it distributes the bulk material evenly in the directions on the periphery thereof, this already resulting in a uniform distribution of the bulk material in the package during arranging of the bulk material. In addition, the cone shape provides the option of accommodating feed means for the gas in its interior. Ribs or other protrusions can also be arranged on the envelope surface of the cone in order to provide for an even better distribution of the bulk material.

The dispensing unit can be displaceable relative to the means for supplying the bulk material to the dispensing unit between a first position, in which it seals the means for supplying the bulk material to the dispensing unit, and a second position in which it leaves clear the means for supplying the bulk material to the dispensing unit for the purpose of dispensing the bulk material. In this way the feed means can be closed and left clear in efficient manner, for instance for the purpose of removing a filled package or placing a package to be filled. In the case of the present invention the use of the dispensing unit for this purpose has the additional advantage that, due to presence of the gas feed means, the dispensing unit cleans itself each time, this not being the case with a regular valve by way of closing means. This latter entails extra-intensive cleaning operations which are not necessary, or less so, with a device according to the invention. The means for supplying the bulk material to the dispensing unit can for instance comprise a feed channel, in an outer end of which the dispensing unit is at least partially received in the first position and which is left at least partially clear by the dispensing unit in the second position.

In the case where the dispensing unit is a cone the means for emitting a gas before dispensing of the bulk material are arranged in the bottom surface of this cone. In the first position, in which the dispensing unit closes the feed channel, this bottom surface can also be oriented adjacently of an outer side of the feed channel, whereby a package situated on this side of the feed channel can be provided with gas via these means arranged in the bottom surface of the cone. These means can for instance be formed in practice by a dispensing opening, as can be the case with the means for emitting the gas during the dispensing. In both cases the dispensing openings can be provided with mechanisms for ensuring that only a gas flow can take place from the opening, and no flow of the bulk material into the opening, for instance through the use of a non-return valve or a similar means.

The means for supplying the bulk material to the dispensing unit can be provided with means for carrying the gas to the dispensing unit. In the case of a feed channel, such as a filling tube, a separate channel such as an inner tube can for instance be provided in this supply channel for supply of the gas. The means for supplying the bulk material to the dispensing unit can also further comprise means, such as a screw, for urging the bulk material to the dispensing unit in controlled manner.

In an advantageous embodiment the means for supplying the bulk material to the dispensing unit comprise a screw which is arranged rotatably around a central supply device for supplying gas to the dispensing unit. In this way the supply device for supplying gas is not exposed to the bulk material and is also protected by the screw, which is for instance manufactured around a cylindrical core.

The device can also be adapted to engage the package gas-tightly around a filling opening thereof. It is possible in this way to ensure that no oxygen enters the package during the filling of the device. This measure is particularly advantageous when it is desirable not to allow the bulk material being blown about during dispensing to leave the package, particularly when it has been decided to also introduce gas into the package outside the feed channel of the bulk material. An extractor can however also be applied for this purpose. Even more advantageous is to displace the dispensing unit relative to the package during dispensing of the bulk material so that bulk material is always dispensed just above the already dispensed bulk material. The dispensing unit is thus always situated here above the already filled level of the package. During dispensing of the bulk material the dispensing unit is displaced upward together with means for supplying the bulk material to the dispensing unit and the means for emitting a gas during the packaging, optionally in proportion to the already supplied bulk material. The upward displacement of the dispensing unit can take place here at a predetermined and set speed, or optionally be linked to the already dispensed quantity of bulk material by means of a control unit. If desired, it is possible for this purpose to keep track of how many revolutions a screw has made and/or to measure a bulk material level in the package (increase) or in the device (decrease) by means of sensors.

BRIEF DESCRIPTION OF THE DRAWINGS

The invention will now be elucidated with reference to the following figures, in which.

DESCRIPTION OF THE PREFERRED EMBODIMENTS

Figure 1:
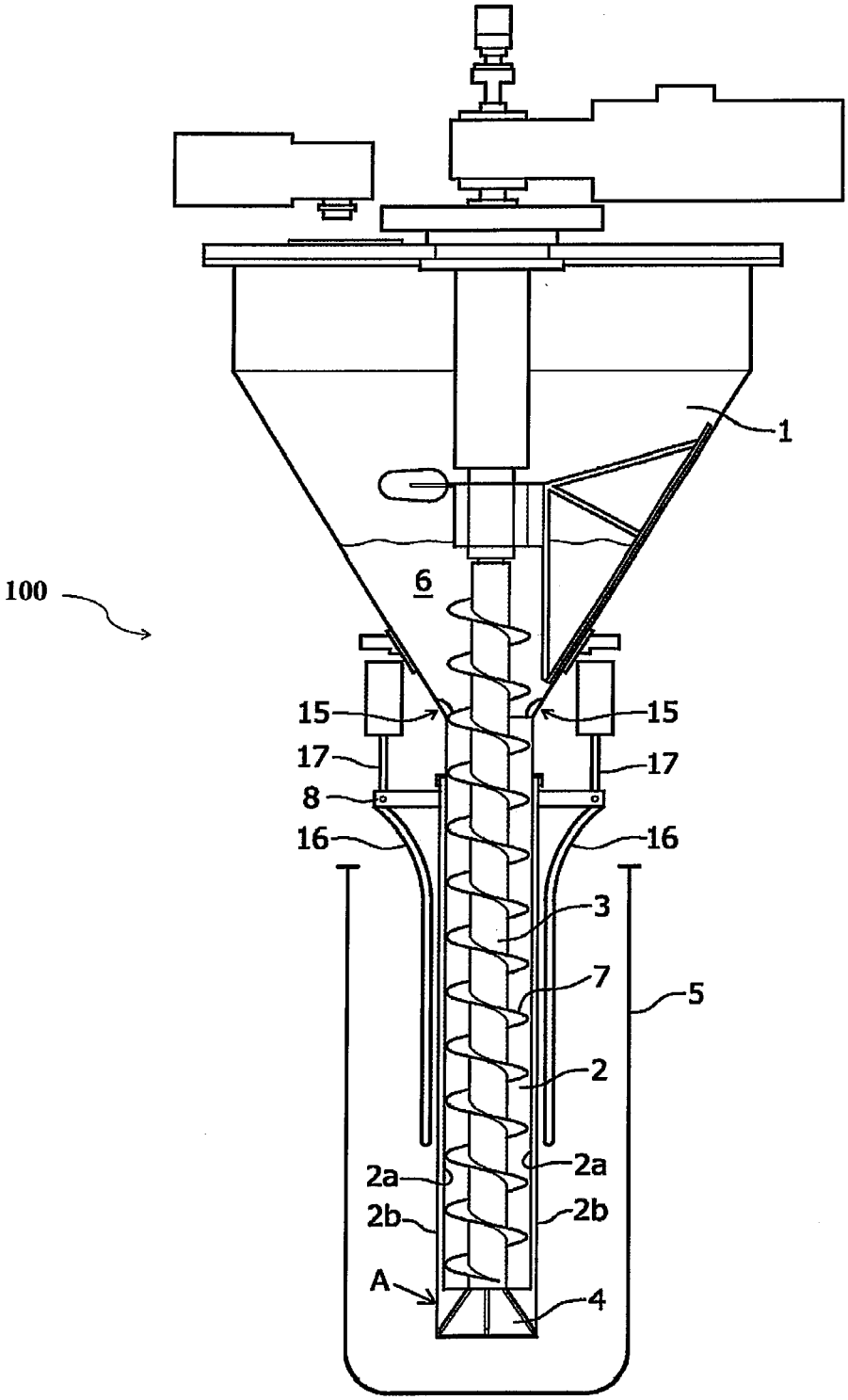
FIG. 1 shows an overview of the device according to the present invention.

FIG. 1 shows device 100 according to the present invention. Device 100 comprises a dispensing unit 4 for dispensing bulk material 6 into a package 5, means 2 formed by a feed channel 2 in the form of a tube in which a screw 7 is arranged for supplying bulk material 6 to dispensing unit 4, and means 3 for emitting a gas during the packaging. The tube consists of an inner tube 2*a* and an outer tube 2*b*, which are telescopically displaceable relative to each other. Means 3 are formed by a gas conduit 3 which is arranged in the interior of screw 7 for feeding the bulk material and which is coupled to dispensing unit 4, which is located in part A in the drawing. The device also comprises a hopper 1 into which the bulk material can be deposited before being packaged in package 5. The hopper is adapted to receive a considerable quantity of bulk material, for instance between 250 and 500 kg. Package 5 is held by holder 8, with which the package can be closed medium-tightly from the atmosphere. During filling the dispensing unit 4 and tube 2 can be moved upward, wherein holder 8 with the package is held in place so that dispensing unit 4 can be held always at the level of bulk material 6 in package 5. The chance of oxygen being enclosed is hereby always kept to a minimum. Gas can also be fed to the bulk material between hopper 1 and channel 2. Gas inlets 15 are present for this purpose. Beyond this location the bulk material 6 no longer comes into contact with oxygen before being dispensed into package 5. Gas can also be introduced directly into the package during filling of the package by means of gas feeds 16, which are arranged parallel to feed channel 2 but which do not drive the gas through the bulk material in the channel. Feeds 15 and 16 can optionally be used in combination with feeds 10 and 11 as described with reference to FIG. 2.

Figure 2:
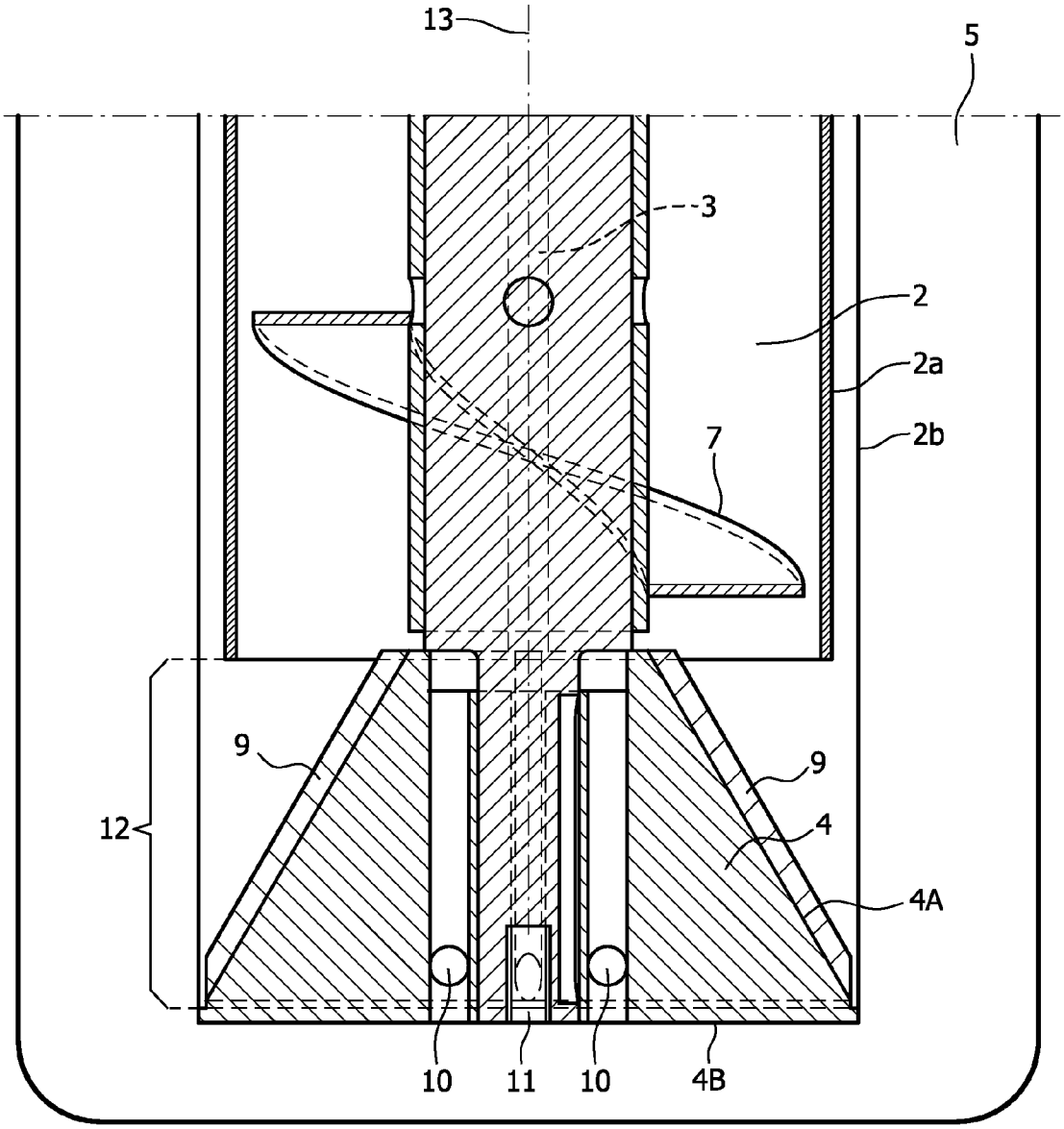
FIG. 2 shows a detail A of FIG. 1.

FIG. 2 shows the detail of part A in FIG. 1. In FIG. 2 corresponding reference numerals designate the same components as in FIG. 1. Shown is how gas conduit 3 situated in the interior of screw 3 is connected to dispensing unit 4. Dispensing unit 4 comprises respective openings 10 and 11 on its outer envelope 4A and on its bottom surface. Openings 10 are used during dispensing to drive gas through the bulk material, while opening 11 is used to introduce gas into the package before and, if desired, also during dispensing. The dispensing unit has protrusions 9 for distributing the bulk material further during the rotation round axis 13, and outer tube 2*b* and dispensing unit 4 are also displaceable relative to each other over a distance 12 for the purpose of leaving clear a passage opening for the bulk material. This passage opening can be left wholly clear for dispensing the bulk material at a full throughfeed speed, or left partially clear—for instance half-open—for fine dosing of the bulk material, for instance for the final quantity of bulk material for the purpose of the precise filling of a package. Provided for the purpose of displacing outer tube 2*b* relative to inner tube 2*a* and dispensing unit 4 are actuators 17, which can for instance be pneumatic or hydraulic actuators. In addition, feed means 2 and the dispensing unit can be displaced together in vertical direction over a distance necessary for filling the package. This distance is in practice between for instance one and two meters, in particular around 1.20 meters.

The dispensing unit can be held in each case just above or just below the level of the already dispensed bulk material in order to obtain an optimal mixing.

Figure 3:
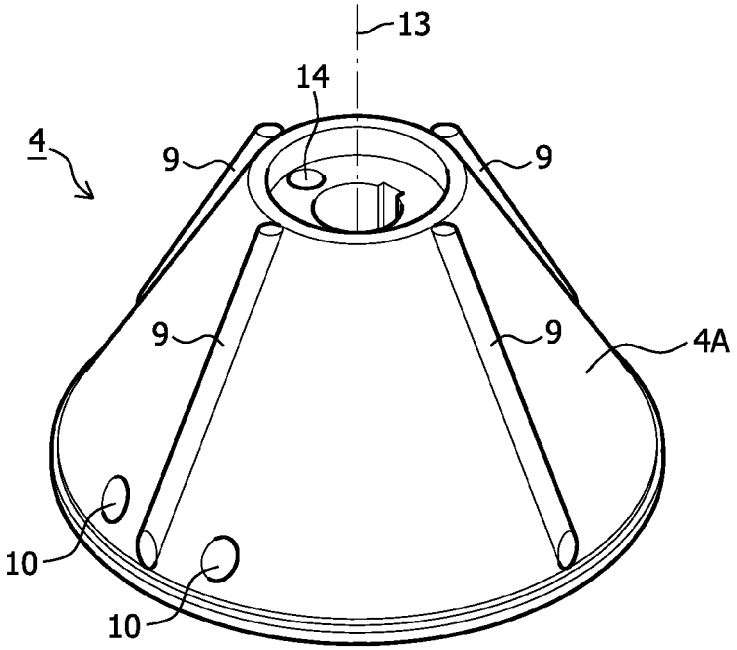
FIG. 3 shows a perspective top view of the device according to the present invention.

FIG. 3 shows a perspective top view of the (detached) dispensing unit 4 of the previous figures. Visible are protrusions 9 for distributing bulk material 6 when the dispensing unit rotates around its rotation axis 13. Arranged in envelope 4A of dispensing unit 4 are openings 10 from which the gas can be carried during the dispensing. In the side remote from the bottom side is arranged a coupling into which a channel 14 debouches through which the gas can be carried to openings 10.

Figure 4:
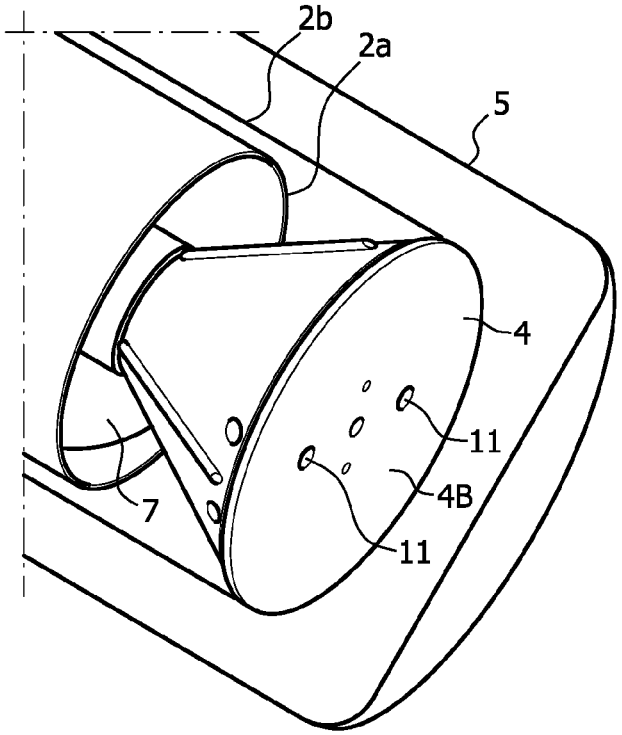
FIG. 4 shows a perspective bottom view of the device according to the present invention.

FIG. 4 shows a perspective bottom view of dispensing unit 4 and feed means 2 for the bulk material. Visible are dispensing openings 11 for the gas, arranged in bottom surface 4B of dispensing unit 4. The dispensing unit is drawn in a situation in which it protrudes partially from dispensing device 2 for the bulk material, whereby dispensing of bulk material 6 is possible.

In addition to the shown non-limitative embodiments, many possible variants can be envisaged, all falling within the scope of protection of the following claims.

The invention claimed is:

1. A device for packaging bulk material, comprising:

a dispensing unit for dispensing the bulk material into a package, the dispensing unit further comprising a diffuser;

a feed channel for supplying the bulk material to the dispensing unit; and a gas conduit for emitting a gas for driving oxygen out of the package before dispensing of the bulk material and for emitting the gas during the packaging;

wherein the gas conduit is adapted to emit the gas to a surface of the diffuser;

wherein the diffuser comprises an envelope having openings configured to emit gas from the gas conduit; and wherein the dispensing unit is moveable relative to the package during dispensing of the bulk material for the purpose of always dispensing bulk material just above the already dispensed bulk material.

2. The device as claimed in claim 1, wherein the diffuser envelope has a cone shape.

3. The device as claimed in claim 1, wherein the dispensing unit is displaceable relative to the feed channel for supplying the bulk material to the dispensing unit between:

a first position in which it seals the feed channel for supplying the bulk material to the dispensing unit; and a second position in which it leaves clear the feed channel for supplying the bulk material to the dispensing unit for the purpose of dispensing the bulk material.

4. The device as claimed in claim 3, wherein in the first position the dispensing unit is at least partially received in an outer end of the feed channel, and wherein in the second position the dispensing unit leaves the outer end of the feed channel at least partially clear.

5. The device as claimed in claim 1, wherein the gas conduit forms openings in a bottom surface of the diffuser for emitting a gas before dispensing of the bulk material.

6. The device as claimed in claim 1, wherein the feed channel for supplying the bulk material to the dispensing unit is provided such that it carries the gas to the dispensing unit.

7. The device as claimed in claim 1, wherein the feed channel for supplying the bulk material to the dispensing unit also comprises a screw for urging the bulk material to the dispensing unit in controlled manner.

8. The device as claimed in claim 7, wherein the screw is arranged rotatably around a central supply device for supplying gas to the dispensing unit.

9. The device as claimed in claim 1, wherein the device is adapted to engage the package gas-tightly around a filling opening thereof.

10. The device as claimed in claim 1, wherein the bulk material is powdered milk.

11. The device as claimed in claim 1, wherein the gas is $CO_2$ or a gas mixture of nitrogen and $CO_2$.

12. A method for packaging bulk material, comprising of:

dispensing the bulk material into a package;

introducing a gas into the package prior to dispensing;

emitting a gas at the position of the feed of the bulk material to the package during packaging; and moving a feed device for the bulk material upward during filling of the package for the purpose of always holding the feed device just above the level of the bulk material in the package.

* * * * *